US005429148A

United States Patent [19]

Hammer

[11] Patent Number: 5,429,148

[45] Date of Patent: Jul. 4, 1995

[54] PORTABLE KIOSK

[76] Inventor: Robert Hammer, 1080 Ashford La., Midlothian, Tex. 76065

[21] Appl. No.: 332,927

[22] Filed: Dec. 15, 1994

[51] Int. Cl.[6] ..... E04H 15/34

[52] U.S. Cl. ..... 135/121; 135/116; 135/119

[58] Field of Search ..... 135/128, 137, 139, 141, 135/115, 119, 87, 900, 901, 902, 121, 116

[56] References Cited

U.S. PATENT DOCUMENTS

| | | | |
|---|---|---|---|
| 1,803,626 | 5/1931 | Lasley | 135/128 |
| 1,990,804 | 2/1935 | Watson | 135/128 |
| 2,690,185 | 9/1954 | Pomykala | 135/137 |
| 2,753,818 | 7/1956 | Green | 135/137 X |
| 3,020,045 | 2/1962 | Moss | 135/137 X |
| 3,453,786 | 7/1969 | Rebarchek | 135/137 |

*Primary Examiner*—Lanna Mai

[57] ABSTRACT

A portable structure to be used by an individual in an upright or seated position. Such a structure will be assembled where desired by first assembling tube connectors and inserting the tube assemblies into the cup shaped receptors around the opposing major body components. This skeleton assembly will then be covered with a suitable flexible material using temporary "S" shaped hooks.

1 Claim, 7 Drawing Sheets

FIGURE 4
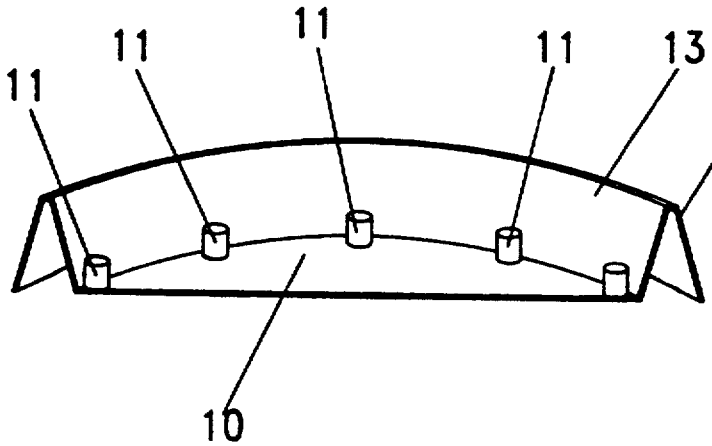
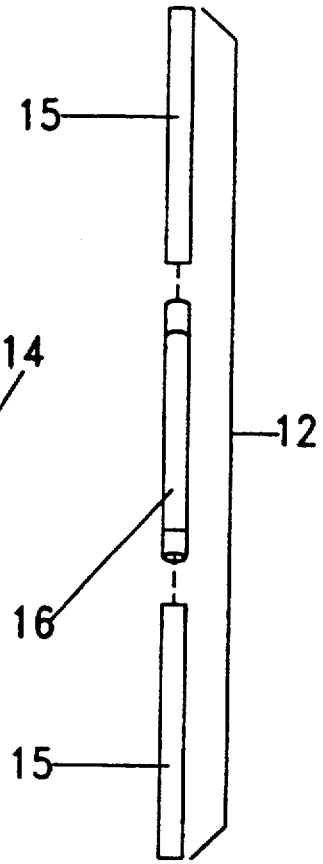
FIGURE 8

PORTABLE KIOSK

FIELD OF THE INVENTION

This invention relates generally to portable outdoor shelters, and in particular shelters that are for use in a standing or sitting position of a single occupant.

1. Background of the Invention

Often there is a requirement for convenient portable shelter from inclement weather or for privacy that will be used by someone in an upright position. A few examples of such a requirement would be a temporary portable toilet containment facility, a hunter's blind, a beach changing booth, a fisherman's all-weather-shelter or a shower stall to name just a few of the possible usages of this invention.

2. Description of Prior Art

According to prior practice standard camping tents are used as temporary structures but have several disadvantages when a requirement is similar to the examples given in the invention background. Most of the examples given in the background of the invention use hard sided bulky box type enclosures that are not easily transported by a single person.

OBJECTS OF THE INVENTION

It is, therefore, the primary object of the portable kiosk to provide a simple-to-erect yet sturdy portable enclosure that will provide shelter from inclement weather.

A second object of the invention is to provide a structure that can be used for privacy when there is a requirement for that type of function.

Still another use of the portable kiosk is it's capability to be used as an advertising media by imprinting the cloth covering with a commercial product logo such as a soda or beer can label.

Yet another aspect of the portable kiosk would be it's use as a portable shower enclosure by simply connecting a shower head and plumbing to an upright tube and providing a drain hole. Such a structure would be used by forest service personnel while taking a break during times of fire fighting or by people involved in the cleanup of hazardous material spills or even by disaster relief teams at refugee camps.

SUMMARY OF THE INVENTION

These and other objects are accomplished in accordance with the present invention wherein a portable structure will be assembled on site by an individual person. The kiosk comprised of a first and second relatively flat body members having first and second major surfaces for being positioned in facing relationship. The first major surface with a extension 13 extending at an obtuse angle from the first major surface, then from said extension will be a second extension 14 extending at an acute angle outward. Around the outer edge of the first major surface and inside of the first extension of the first major surface will be a plurality of receptors 11 equally spaced into which structural tube assemblies 12 will be inserted to join the opposing major body members 10 of the structure. Both the upper and lower major body members of the structure are the same design making them interchangeable. The connecting assemblies 12 of the structure will be multiple part tubes. These assemblies will consist of one tube 16 having expanded ends into which two equally sized tubes 15 may be partially inserted. Each part of the tube assembly will be shorter in length then the diameter of the first major body part surface so that when taken apart they will be stored in the space between two component body members. After the tube assemblies 12 are inserted into two opposing body members receptor components a flexible material 20 will be hooked to the outer extension 14 by attaching "S" hooks 21 thru metal grommets 22 spaced a specified distance along and within 0.5 inches of the upper and lower edge in the material and then over the top and under the bottom body member second extensions. A single flat piece of material will be wrapped around the perimeter of the first and second body member second extensions in such a way that the edges of said material will overlap for closure. This material may be clear, net, waterproof, decorated or just about any other design.

BRIEF DESCRIPTION OF DRAWINGS

Further objects and advantages of the invention will be apparent from the detailed description and clams when read in conjunction with the accompanying drawings.

FIG. 4 is a cutaway view of said component which will be used as a top or bottom of a structure.

FIG. 8 is an exploded view of a tube assembly used to connect the major body parts.

DETAILED DESCRIPTION OF THE PREFERRED EMBODIMENT

In the description that follows like parts are marked throughout the specifications and drawings. The drawings are not necessarily to scale and in some instances have been exaggerated in order to more clearly depict certain features of the invention.

Figure 1:
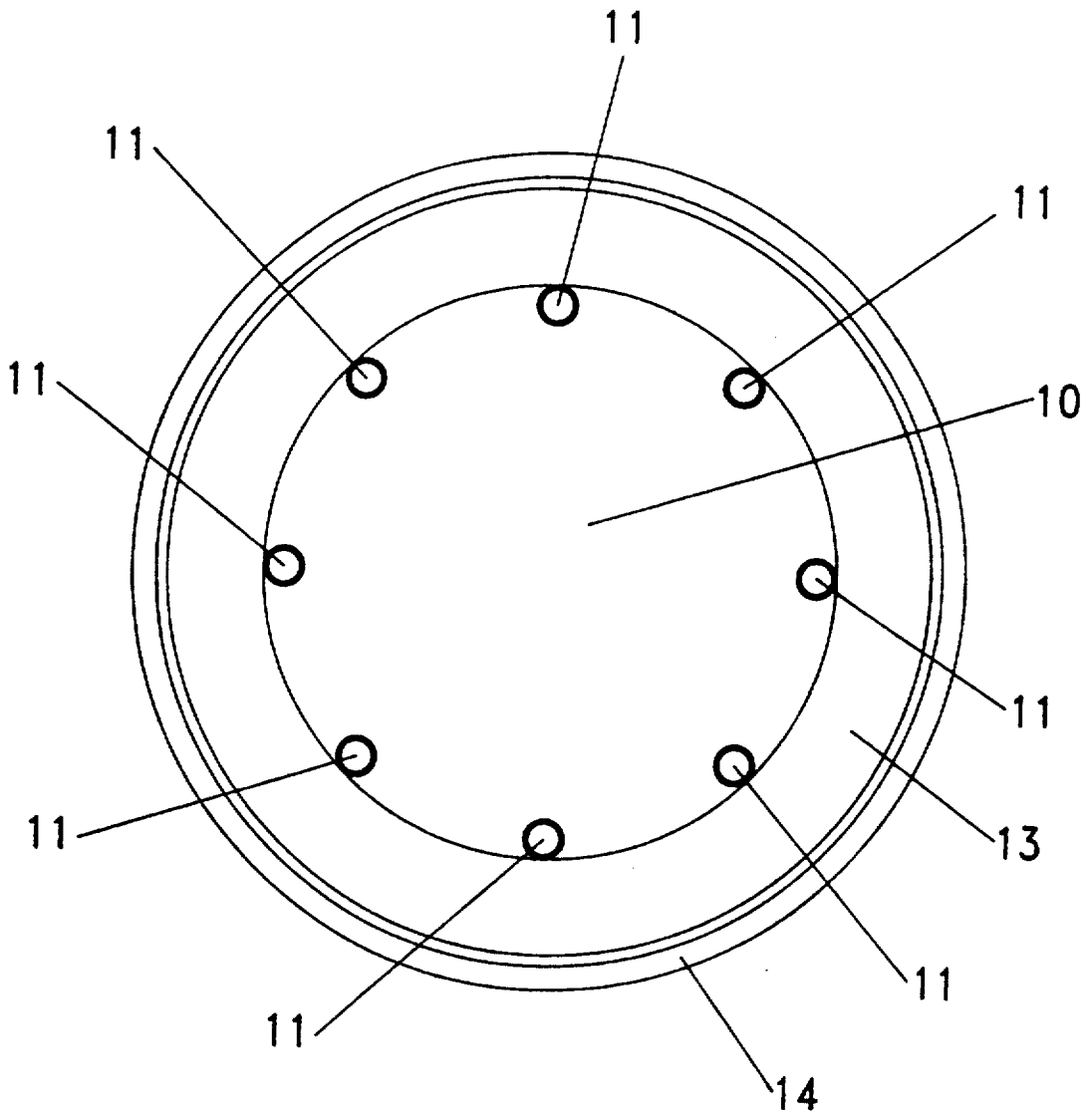
FIG. 1 is a perspective view showing the inside of the major body member component of the structure. Said component will be the top or bottom of the structure.

Referring to FIG. 1 according to the present invention the first and second body members comprised of a flat surfaced plane 10 having an upper and lower surface. The upper surface has along it's outer perimeter a lip 13 extending at an obtuse angle at a specified angle and having a height of a specified amount. From said lip will be a lip 14 extending in the opposite direction at an acute and specified angle. Around the perimeter of the plane 10 and perpendicular to said plane will be several cup shaped tube receptors 11 with an inside diameter large enough to accept an upright tube section 15.

Figure 2:
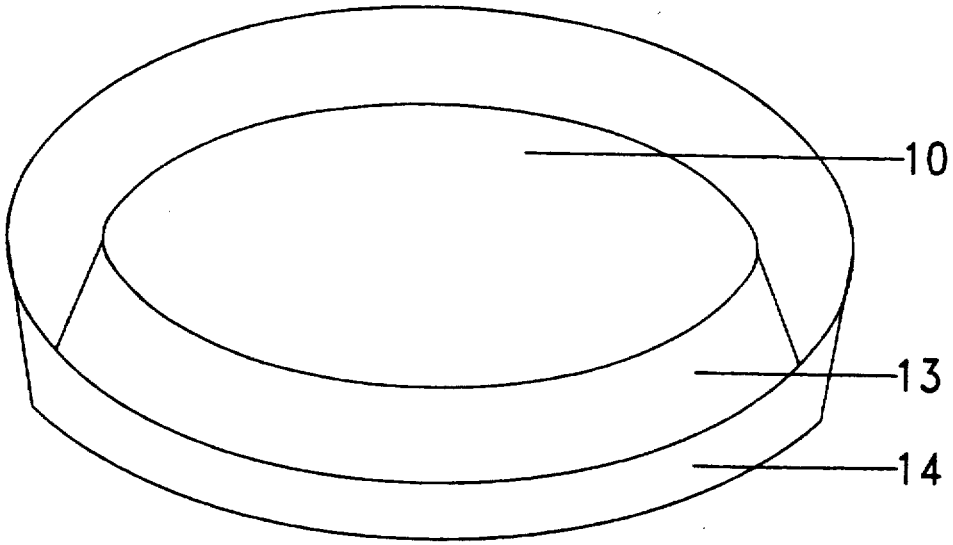
FIG. 2 is a perspective view showing the outer-side of said component.

Referring to FIG. 2 according to the present invention all of the attributes of the prior paragraph apply. Essentially the top and bottom of the invention are identical with the only exception being the orientation of each part which will be opposing each other when a shelter is assembled for use.

Figure 3:
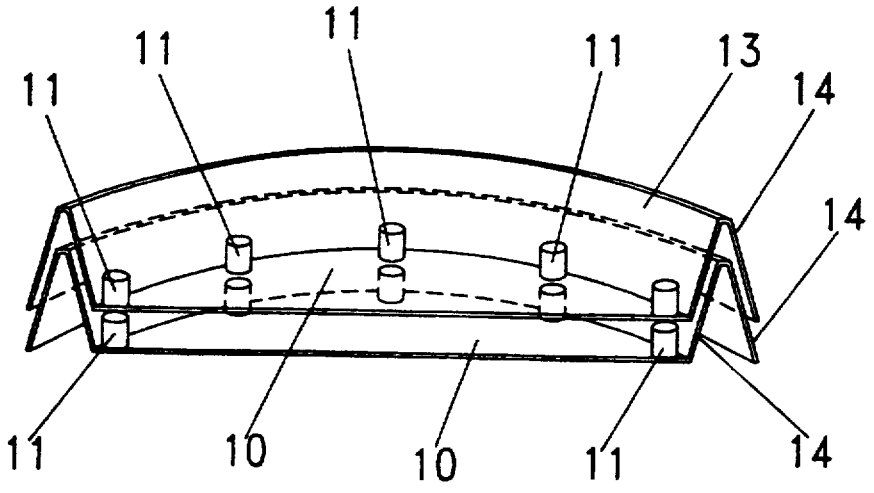
FIG. 3 is a cutaway view of 2 copies of the major body member component nested to conserve space during transport.

Referring to FIG. 3 two body members of a shelter may be nested for storage or shipping.

Figure 5:
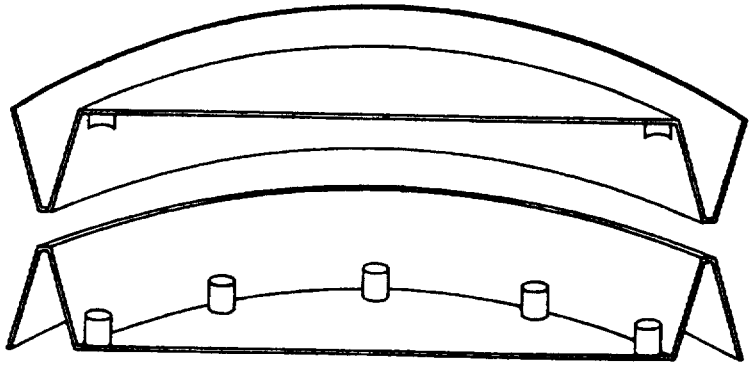
FIG. 5 is a cutaway view of two major body member components which when placed in this configuration and held together with an elastic strap having "S" type hooks (not shown) placed over the outer lips will provide storage for the outer wrapping as well as tube sections.

Referring to FIG. 5 the opposing body member components will be transported facing each other and will be held together by a sufficient number of elastic cords with "S" hooks on each end.

Figure 6:
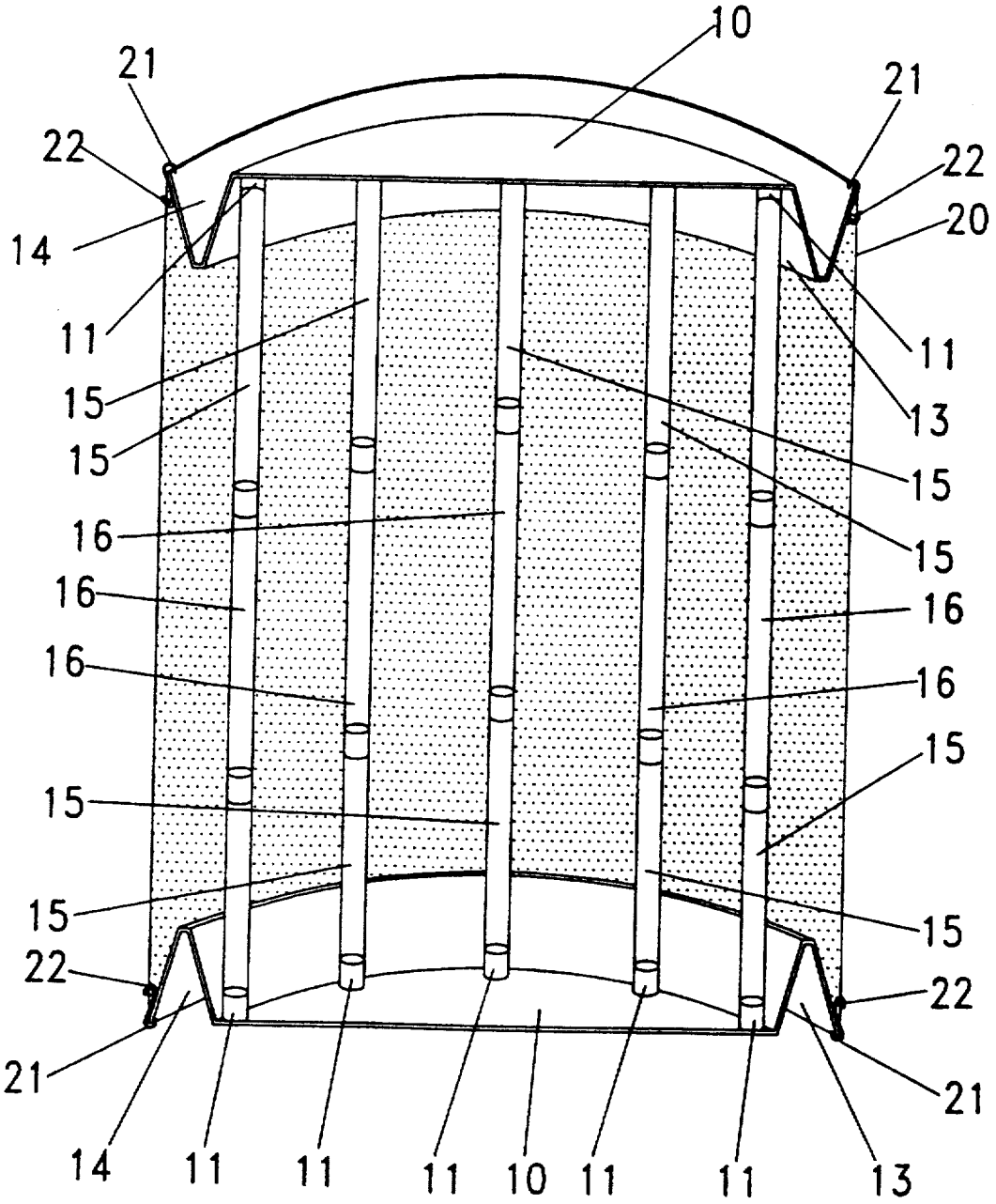
FIG. 6 is cutaway view of a structure skeleton depicting the two major body members, the tube assemblies and the outer covering.

Referring to FIG. 6 two body members are attached to each other with a series of sectional tubes.

Figure 7:
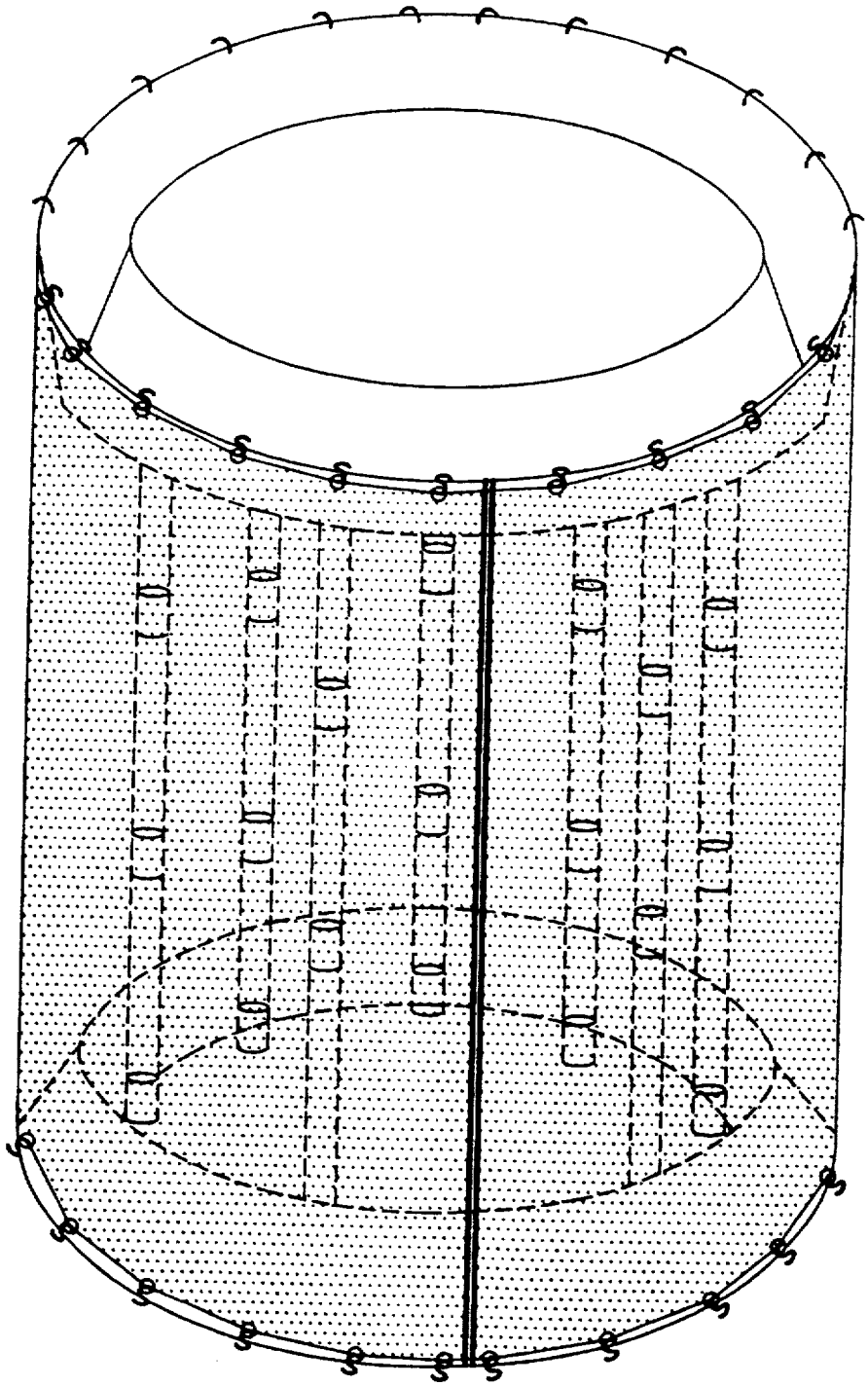
FIG. 7 is a view of a fully assembled kiosk.

Referring to FIG. 7 a flexible material 20 may be attached using "S" hooks 21 hooked to the outer lip of two opposing body members attached by structural tubing. Such material may be of cloth, mesh, canvas or even clear plastic or combinations of material depending on the usage of the structure. For example an ice fisherman may desire clear flexible plastic which would inhibit the transfer of cold air from outside to inside while the inside air could be heated by the sun's rays, or a hunter may desire a combination of netting, while a camper may want simply a canvas type material.

Campers, fishermen, hunters and beach going individuals will appreciate the convenience of a simple to erect structure for privacy and protection from the weather. This portable kiosk will provide that convenience with portability, structural soundness and self storing capability. The major body member components will be molded from plastic or fiberglass with a preferred diameter size of 36 inches and the connecting tubes will be 25 inches in length.

Various embodiments of this invention have been described in detail. Since it is obvious that changes in and additions to the above described preferred embodiment may be made without departing from the nature, spirit and scope of the invention, the invention is not to be limited to said details except as set forth in the appended claim.

What is claimed is:

1. A portable shelter structure comprising:

a) a first and second relatively flat body members, each of said body members having opposed surfaces and a perimeter; said first body member being positioned on the supporting surface and said second body member being spaced vertically from said first body member;

b) a plurality of cup shaped receptors being formed perpendicularly to one surface and being spaced equally about the perimeter of each body member; the receptors of said first body members being vertically aligned to and facing the receptors of spaced-apart second body member;

c) a lip extension extending outwardly from the perimeter of said body member at an obtuse angle, and a second lip extending outwardly from said lip extension at an acute angle;

d) a plurality of elongated supporting members, each supporting member includes telescopic tubular sections;

said supporting members being received in the aligned receptors of said spaced-apart body members forming a framework of the shelter structure;

e) a semi-elastic fabric having a plurality of equally spaced grommets along opposite edges;

f) a plurality of s-shaped connectors connected to said grommets of said fabric; said connectors secure each edge of said fabric to a correspond second lip of said spaced-apart body members.

* * * * *